US007616088B1

(12) United States Patent
Baker et al.

(10) Patent No.: US 7,616,088 B1
(45) Date of Patent: Nov. 10, 2009

(54) LOW LEAKAGE INDUCTANCE TRANSFORMER

(75) Inventors: Dan Baker, Medina, OH (US); Wayne C. Goeke, Hudson, OH (US)

(73) Assignee: Keithley Instruments, Inc., Cleveland, OH (US)

( * ) Notice: Subject to any disclaimer, the term of this patent is extended or adjusted under 35 U.S.C. 154(b) by 0 days.

(21) Appl. No.: 11/758,310

(22) Filed: Jun. 5, 2007

(51) Int. Cl.
*H01F 27/28* (2006.01)

(52) U.S. Cl. ..... 336/229

(58) Field of Classification Search ..... 336/65, 336/83, 200, 225, 229, 232, 220–222
See application file for complete search history.

(56) References Cited

U.S. PATENT DOCUMENTS 4,205,288 A * 5/1980 Lin et al. ..... 336/5
4,763,093 A * 8/1988 Cirkel et al. ..... 336/58
4,969,078 A * 11/1990 Yamamoto et al. ..... 363/24
5,430,613 A * 7/1995 Hastings et al. ..... 361/760
5,508,673 A * 4/1996 Staszewski ..... 336/184
7,199,569 B1 * 4/2007 Nakahori ..... 323/355
2006/0044104 A1 * 3/2006 Derks ..... 336/229
2006/0132276 A1 * 6/2006 Harding ..... 336/229

* cited by examiner

*Primary Examiner*—Tuyen Nguyen
(74) *Attorney, Agent, or Firm*—Pearne & Gordon LLP

(57) ABSTRACT

A toroidal step-up or step-down transformer includes a toroidal magnetic core, a primary formed from a plurality of primary windings, and a secondary formed from a plurality of secondary windings. Parallel connected windings are added to at least one of the primary and secondary to make the number of primary windings equal to the number of secondary windings, the primary and secondary windings being arranged symmetrically around the core.

5 Claims, 6 Drawing Sheets

LOW LEAKAGE INDUCTANCE TRANSFORMER

BACKGROUND OF THE INVENTION

The present invention relates to toroidal transformers and, in particular, to low leakage inductance transformers.

U.S. Pat. No. 7,009,486 discloses toroidal transformers constructed on printed circuit boards and is incorporated herein by reference. The transformers of the patent are all one-to-one transformers, suitable, for example, for isolation purposes.

Referring to FIG. 2, such a prior art transformer 10 is shown schematically with a center-tapped primary winding 12 formed from the turns 14, 16, 18, 20. A magnetic core 22 couples the winding 12 to the center-tapped secondary winding 24 formed from the turns 26, 28, 30, 32.

Referring to FIGS. 1 and 3, the transformer 10 may be advantageously implemented with an annular magnetic core 22; a printed circuit board 34 containing traces 14A, 16A, 18A, 20A forming first portions of the winding 12, and traces 26A, 28A, 30A, 32A forming first portions of the winding 24; and staple-like conductors staples 14A, 16A, 18A, 20A forming second portions of the winding 12 and staples 26A, 28A, 30A, 32A forming second portions of the winding 24.

The core 22 is enlaced by the staples 14A, 16B, 18B, 20B, 26B, 28B, 30B, 32B when they are electrically and mechanically connected to the board 34, for example, by soldering.

The board 34 may advantageously be of a multilayer type with for example, (see FIG. 3A) a conductor (e.g., trace 26A) shielded above and below by a wider conductor (e.g., traces 36). The traces may be, for example, twice as wide as the sandwiched trace.

Many power applications draw large current from only one polarity of a power supply at a time. As a result, the large current flow in the secondary of a transformer flows in the winding above the center tap for one half of the transformer's input cycle and flows in the winding below the center tap for the other half of the input cycle. Similarly, it is common to drive a transformer's primary using a push-pull circuit. This results in current flowing only in the winding above the primary's center tap for the first half of the push-pull cycle and then flowing in the winding below the center tap during the other half of the push-pull cycle.

The transformer 10 takes this into account to minimize leakage inductance. The staple 14B and the staple 16B; the staple 26B and the staple 28B; the staple 18B and the staple 20B; and the staple 30B and the staple 32B are located on opposite sides of the transformer 10. By using this symmetrical arrangement of the staples, the mutual inductances between turns that are carrying large currents at the same time are reduced.

Displacement current (for example, parasitic capacitive leakage) between the primary and secondary winding is another source of common mode current/noise.

By locating primary staples adjacent to corresponding secondary staples, adjacent staples are electrically moving in the same direction at the same time, thus minimizing displacement current. For example, staple 14B is adjacent staple 26B, staple 16B is adjacent staple 28B, staple 18B is adjacent staple 30B, and staple 20B is adjacent staple 32B.

Typically, the center taps of the transformer are static with respect to the transformer signals and therefore do not couple common mode current. This advantageously allows the wide traces 36 to be added to the board 34 above and below electrically moving traces. All of the traces 36 are connected to either the primary or the secondary center tap. The traces 36 can act as either an electrostatic shield or a ground return, further improving the performance of the transformer 10.

SUMMARY OF THE INVENTION

A toroidal step-up or step-down transformer includes a toroidal magnetic core, a primary formed from a plurality of primary windings, and a secondary formed from a plurality of secondary windings. Parallel connected windings are added to at least one of the primary and secondary to make the number of primary windings equal to the number of secondary windings, the primary and secondary windings being arranged symmetrically around the core.

DESCRIPTION OF THE PREFERRED EMBODIMENTS

Figure 1:
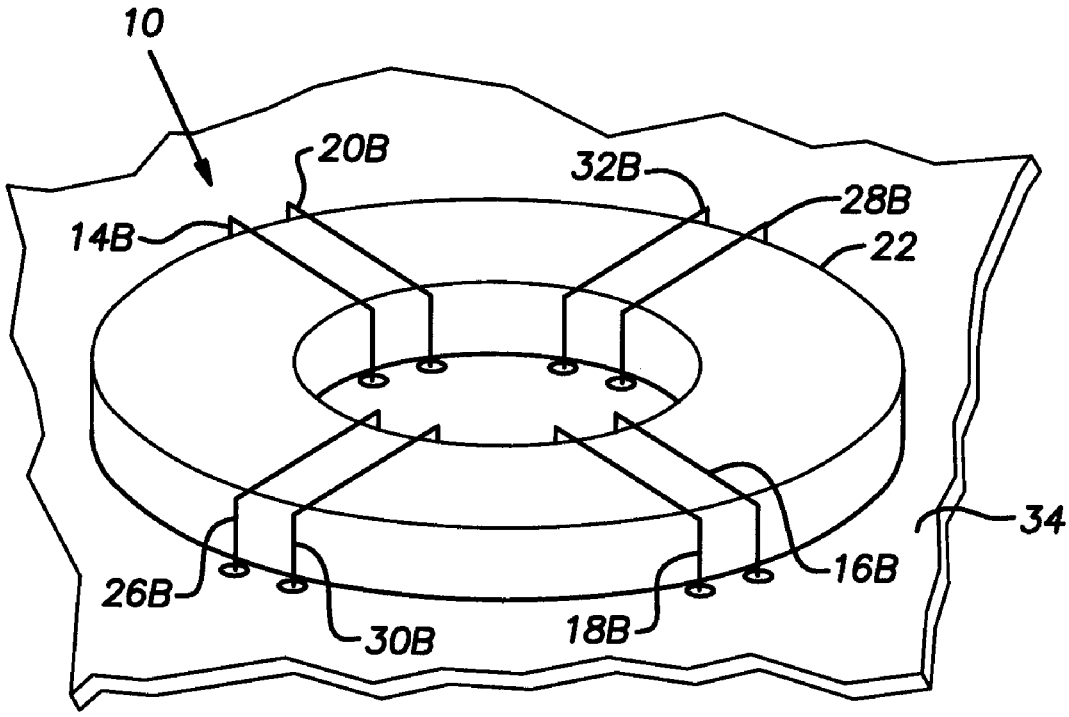
FIG. 1 PRIOR ART
FIG. 1 is a perspective view of a prior art transformer.
Figure 2:
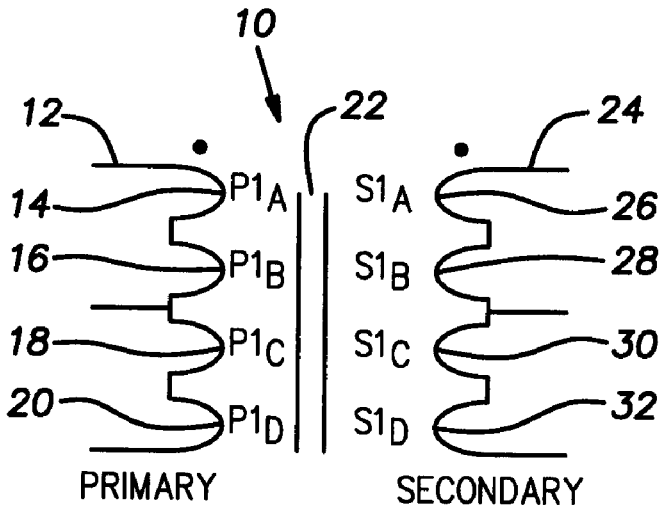
FIG. 2 PRIOR ART
FIG. 2 is a schematic diagram of the transformer of FIG. 1.
Figure 3:
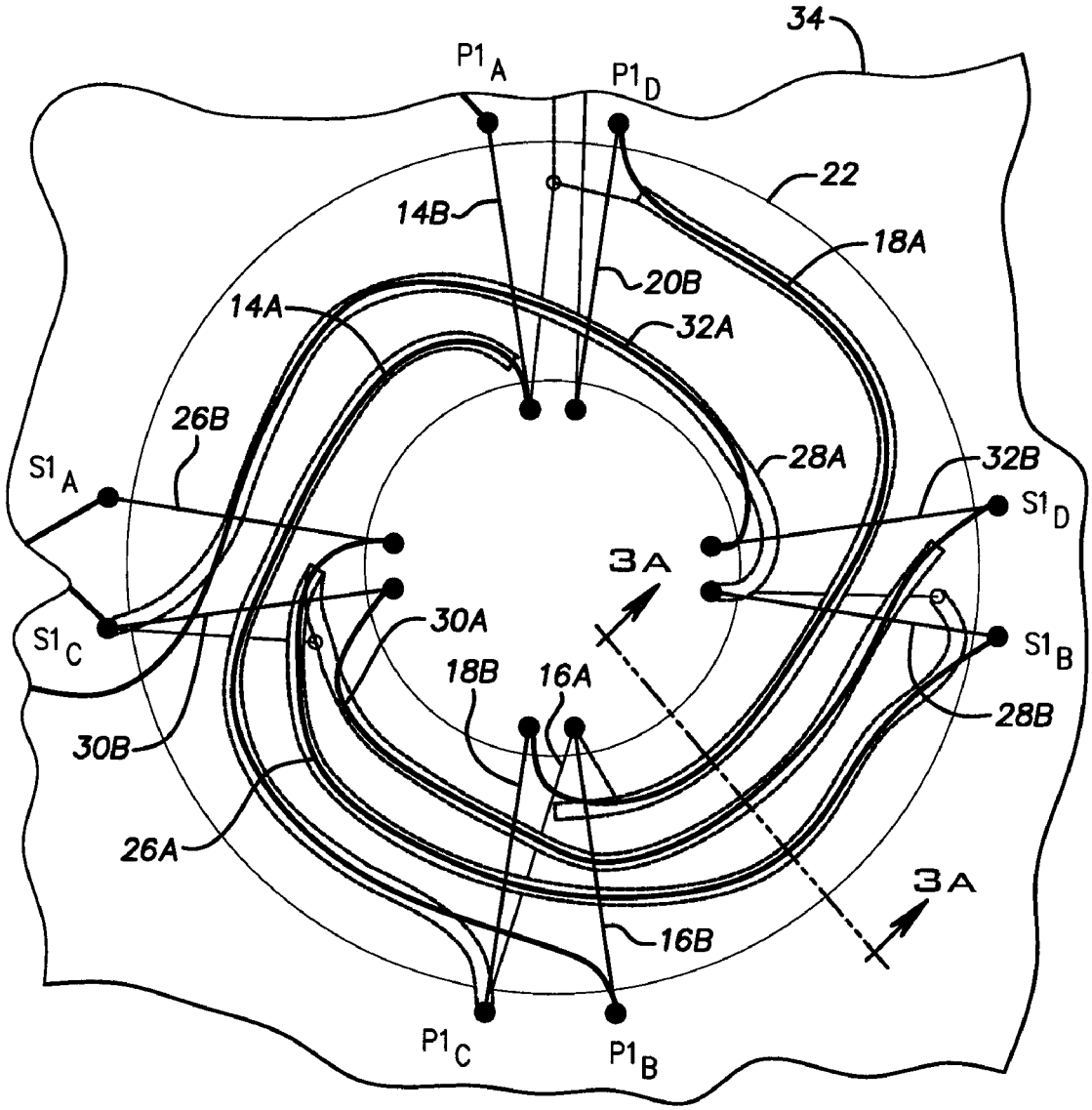
FIG. 3 PRIOR ART
FIG. 3 is a top x-ray view of the transformer of FIG. 1.
Figure 3A:
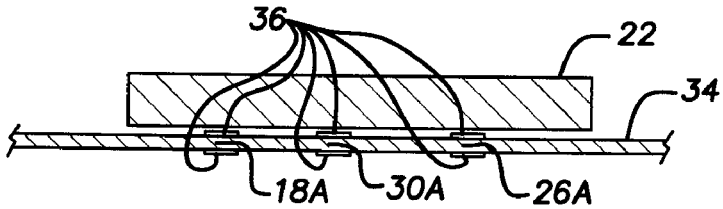
FIG. 3A PRIOR ART
FIG. 3A is a cross sectional view along the line 3A.
Figure 4A:
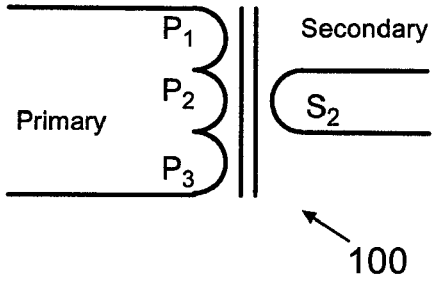
FIG. 4A is a schematic diagram of a 3:1 transformer.
Figure 4B:
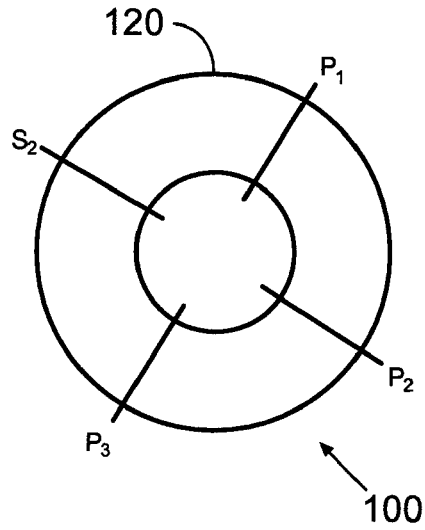
FIG. 4B is an example of a toroidal transformer implementation of the transformer of FIG. 4A.

Referring to FIG. 4A, a step-down transformer 100 includes three primary windings $P_1$, $P_2$, $P_3$ and a single secondary winding $S_2$ (if the primary and secondary designations are reversed, it is instead a step-up transformer). Similar to FIGS. 1 and 3, FIG. 4B schematically indicates a possible implementation of the transformer 100 as a toroidal transformer with the windings $P_1$, $P_2$, $P_3$, $S_2$ formed around a core 120. The transformer 100 may be implemented, for example, on a printed circuit board using conductive staples as illustrated in FIGS. 1 and 3 or conventional windings, such as wire turns may be used.

Unfortunately, because the transformer 100 is a step-down or step-up transformer (rather than a 1:1 transformer), the current and voltage in each of the primary windings does not match that of the secondary winding (three times the current in each secondary winding as in each primary winding). This results in high leakage inductance, because the windings cannot be arranged to cancel the leakage.

Figure 5A:
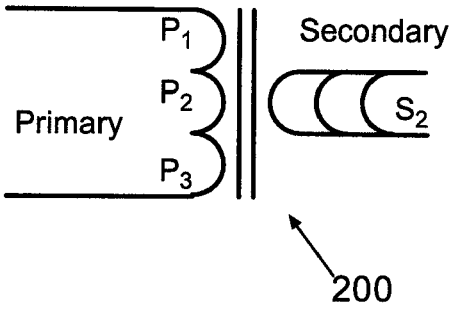
FIG. 5A is a schematic diagram of another 3:1 transformer.
Figure 5B:
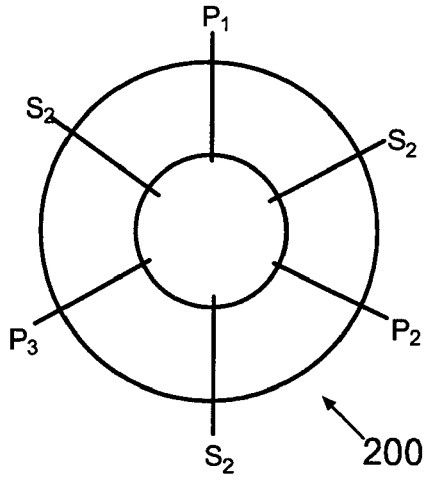
FIG. 5B is an example of a toroidal transformer implementation of the transformer of FIG. 5A.

Referring to FIG. 5A, a transformer 200 retains the step-down or step-up characteristics of the transformer 100, but has three secondary windings $S_2$ connected in parallel. This addition of parallel connected windings allows the winding configuration of FIG. 5B to be used. In FIG. 5B, each of the primary windings $P_1$, $P_2$, $P_3$ are symmetrically arranged with alternating secondary windings $S_2$. The current in each of the windings now matches that of the adjacent windings resulting in reduced leakage inductance.

Figure 6A:
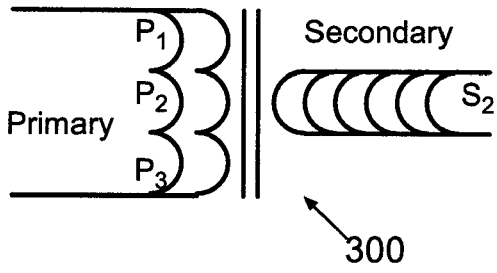
FIG. 6A is a schematic diagram of an additional 3:1 transformer.
Figure 6B:
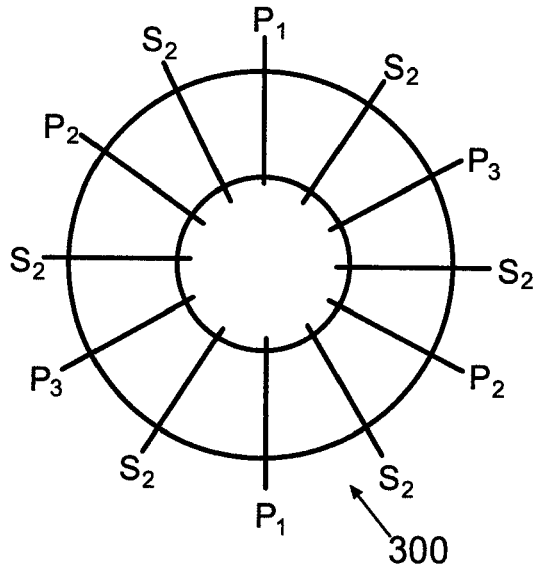
FIG. 6B is an example of a toroidal transformer implementation of the transformer of FIG. 6A.

Referring to FIG. 6A, the transformer 300 further lowers leakage inductance by adding further parallel connected windings, while still retaining the step-down or step-up characteristics of the transformer 100. Referring to FIG. 6B, each of the now doubled primary windings $P_1$, $P_2$, $P_3$ are even more closely symmetrically arranged with alternating secondary windings $S_2$ (also double the number), further lowering the leakage inductance.

In general, parallel connected windings are added to at least one of the primary and secondary to make the number of primary windings equal to the number of secondary windings and the primary and secondary windings are arranged symmetrically around the core.

Figure 7A:
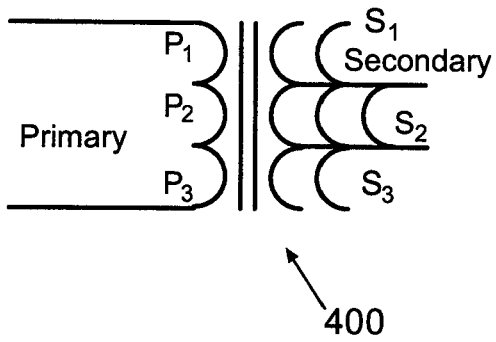
FIG. 7A is a schematic diagram of still another 3:1 transformer.
Figure 7B:
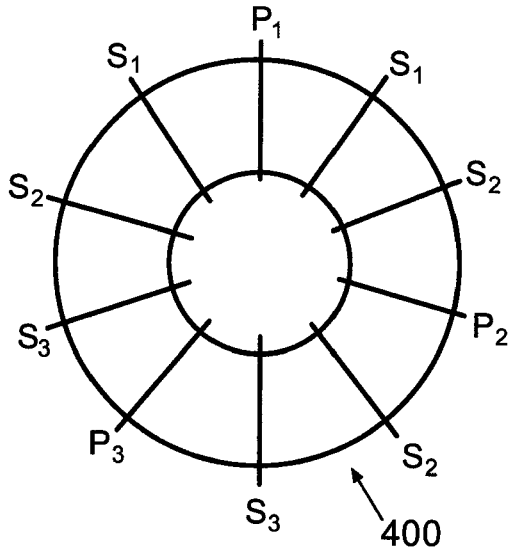
FIG. 7B is an example of a toroidal transformer implementation of the transformer of FIG. 7A.

It is also desirable to reduce further the capacitive coupling of charge between the primary windings and the secondary windings. Referring to FIG. 7A, half-connected windings $S_1$, $S_3$ may be added to a transformer 400, while still retaining the step-down or step-up characteristics of the transformer 100. The windings $S_1$, $S_3$ are not current-carrying, but still have the induced voltage from the primary windings. Referring to FIG. 7B, the primary windings $P_1$, $P_2$, $P_3$ are each surrounded by like voltage secondary windings. The coupling between adjacent primary and secondary windings do not carry charge because the voltages are the same.

Figure 8A:
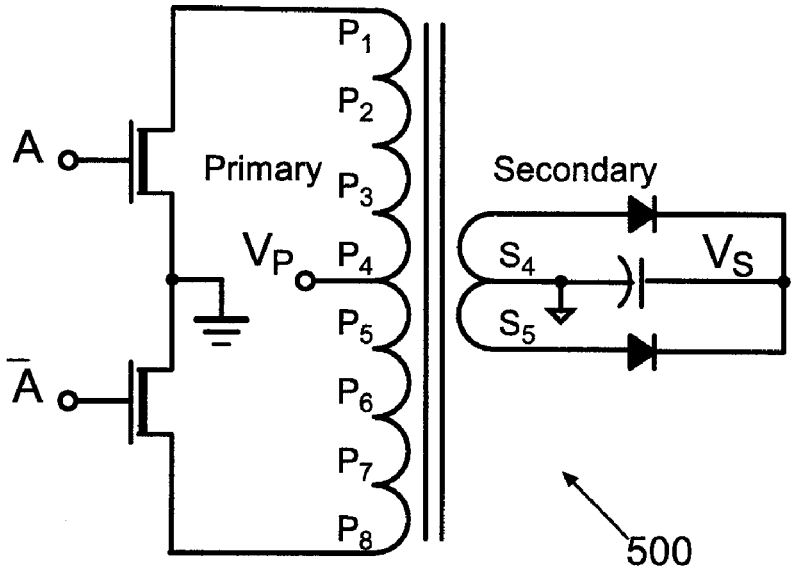
FIG. 8A is a schematic diagram of a circuit with a 4:1 transformer.
Figure 8B:
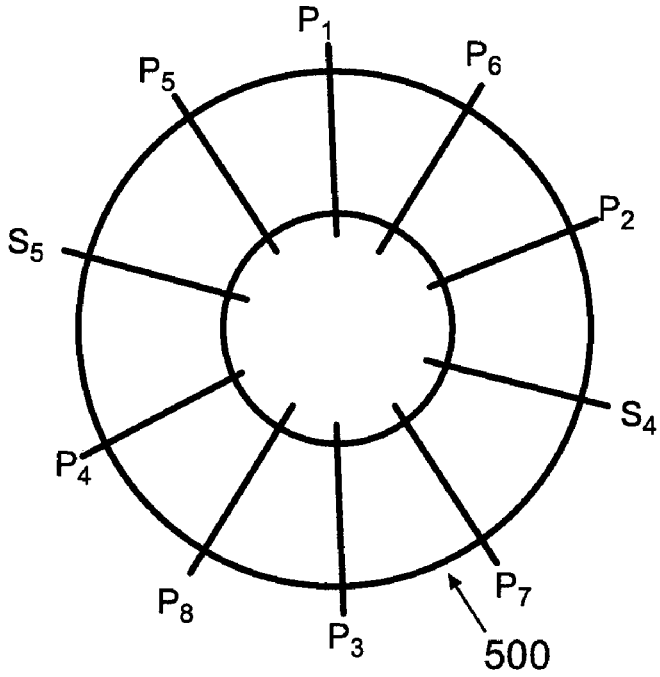
FIG. 8B is an example of a toroidal transformer implementation of the transformer of FIG. 8A.

In general, at least one half-connected winding is added to at least one of the primary and secondary to provide an equal voltage winding adjacent to a winding of the other of the primary and secondary As a further example, referring to FIG. 8A, a typical push-pull driven circuit with a 4:1 transformer 500 can be implemented with a winding arrangement as shown in FIG. 8B. However, this arrangement does not have the advantages described above.

Figure 9A:
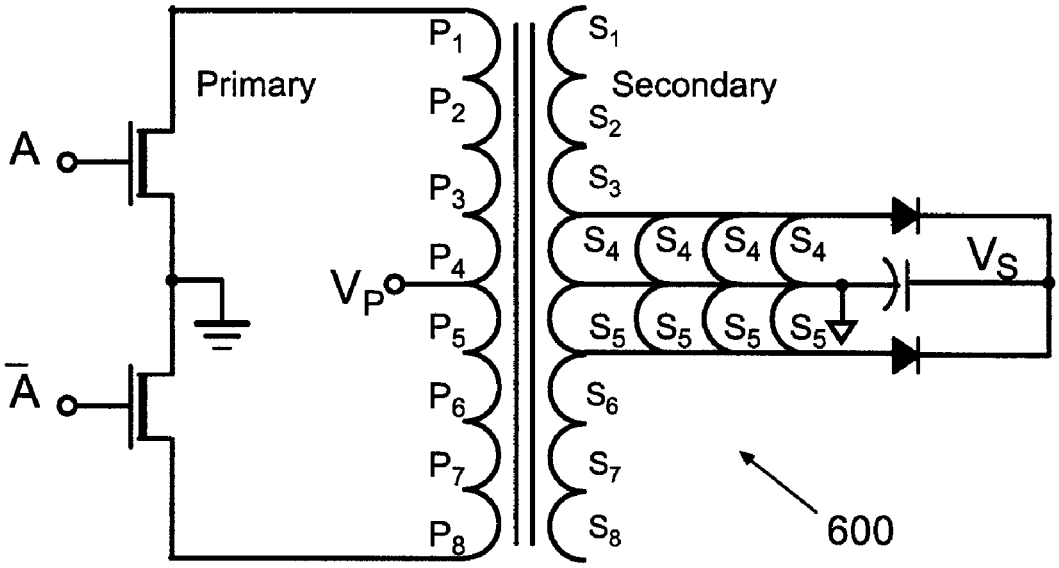
FIG. 9A is a schematic diagram of a circuit with a 4:1 transformer.
Figure 9B:
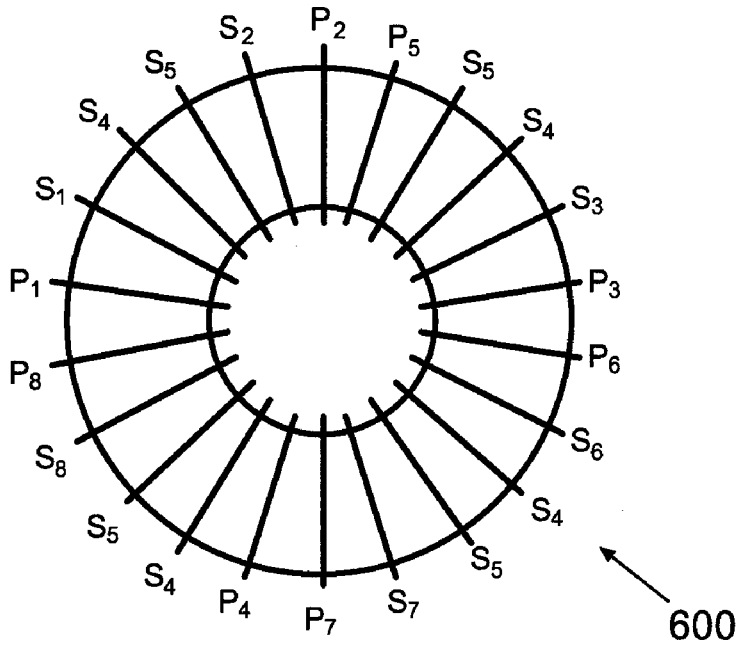
FIG. 9B is an example of a toroidal transformer implementation of the transformer of FIG. 9A.

Referring to FIG. 9A, both parallel connected windings ($S_4$, $S_5$) and half-connected windings ($S_1$, $S_2$, $S_3$, $S_6$, $S_7$, $S_8$) are added to the transformer 500 to form the transformer 600. Referring to FIG. 9B, a possible implementation of the transformer 600 that reduces leakage inductance and capacitive coupling is illustrated.

The windings capacitively couple to each other. The strongest coupling is to adjacent windings, therefore, primary and secondary windings that are adjacent primarily determine the primary to secondary leakage current. Therefore, if extra secondary windings are added to match the primary windings, adjacent primary-secondary windings can be of like kind.

The current that flows in the primary times the number of primary windings is approximately equal to the current that flows in the secondary times the number of secondary windings. The current in all primary windings must be equal but some are far from any secondary winding. The lack of closeness results in higher leakage inductance. Higher leakage inductances resonate with capacitances producing noise. Adding parallel windings to the secondary allows these windings to be placed nearer all primary windings. The parallel windings will each carry the current needed to minimize the leakage inductance.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A toroidal step-up or step-down transformer, said transformer comprising:

a toroidal magnetic core;

a primary formed from a plurality of primary windings; and a secondary formed from a plurality of secondary windings, wherein parallel connected windings are added to at least one of said primary and secondary to make the number of primary windings equal to the number of secondary windings, the primary and secondary windings being arranged in radial symmetry around the core.

2. A transformer according to claim 1, further comprising at least one half-connected winding added to at least one of said primary and secondary to provide an equal voltage winding adjacent to a winding of the other of said primary and secondary.

3. A transformer according to claim 1, wherein a portion of said windings are formed by printed circuit board traces.

4. A toroidal step-up or step-down transformer, said transformer comprising:

a toroidal magnetic core;

a primary formed from a plurality of primary windings;

a secondary formed from a plurality of secondary windings, wherein parallel connected windings are added to at least one of said primary and secondary to make the number of primary windings equal to the number of secondary windings, the primary and secondary windings being arranged symmetrically around the core; and at least one half-connected winding added to at least one of said primary and secondary to provide an equal voltage winding adjacent to a winding of the other of said primary and secondary.

5. A transformer according to claim 4, wherein a portion of said windings are formed by printed circuit board traces.

* * * * *